United States Patent [19]

Schedele

[11] 4,342,019

[45] Jul. 27, 1982

[54] ELECTROMAGNETIC RELAY WITH A FLAT ARMATURE

[75] Inventor: Helmut Schedele, Hoegling, Fed. Rep. of Germany

[73] Assignee: Siemens Aktiengesellschaft, Berlin & Munich, Fed. Rep. of Germany

[21] Appl. No.: 211,394

[22] Filed: Nov. 28, 1980

[30] Foreign Application Priority Data

Dec. 13, 1979 [DE] Fed. Rep. of Germany ..... 2950243

[51] Int. Cl.[3] ..... H01H 3/00; H01F 7/08; H01H 51/08

[52] U.S. Cl. ..... 337/274; 335/128; 335/192; 335/203

[58] Field of Search ..... 335/203, 270, 274, 275, 335/276, 192, 128, 135, 187

[56] References Cited

U.S. PATENT DOCUMENTS 3,505,629 4/1970 Krautwald et al. ..... 335/275
3,701,066 10/1972 Bosch et al. ..... 335/274

*Primary Examiner*—Harold Broome
*Attorney, Agent, or Firm*—Hill, Van Santen, Steadman, Chiara & Simpson

[57] ABSTRACT

An electromagnetic relay has a flat armature which is normally biased away from a pole plate by a bearing spring attached to the armature which is mounted in a recess in a yoke plate, and is clamped thereto. A particularly low friction mounting is achieved by specific selection of the ratio of the distance between the bearing point of the armature and the clamping point of the bearing spring, to the distance between the point of attachment of the bearing spring to the armature and the bearing point.

5 Claims, 3 Drawing Figures

ELECTROMAGNETIC RELAY WITH A FLAT ARMATURE

BACKGROUND OF THE INVENTION

1. Field of the Invention

The present invention relates to electromagnetic relays, and in particular to electromagnetic relays having a flat armature mounted with a bearing edge which is rolled on a yoke plate and is connected to the yoke by a bearing spring for normally biasing the armature away from a pole plate.

2. Description of the Prior Art

Electromagnetic relays employing flat armatures having a bearing spring have long been in use in many relay magnet systems, such as, for example as is disclosed in U.S. Pat. No. 3,505,629. If, in such systems, the bearing spring acts on that side of the armature which faces away from the yoke plate, an undesireably high degree of friction occurs between the bearing edge of the armature and the yoke plate. Although this friction can be avoided by arranging the bearing spring directly on the yoke between the yoke surface and the armature, as is disclosed in U.S. Pat. No. 3,701,066, a bearing spring arranged in this manner frequently prevents direct contact between the armature and the yoke, so that the magnetic circuit is not optimally closed. If such magnetic systems are used in relays having relatively large dimensions, such impairment of the magnetic circuit may be compensated by an appropriate dimensioning of the overall magnet system. This approach, however, cannot be employed in miniaturized relays.

SUMMARY OF THE INVENTION

It is an object of the present invention to provide an electromagnetic relay with a flat armature which is mounted so as to be substantially free of friction, and simultaneously insuring an optimum transition of flux between the individual components of the magnetic circuit, in particular between the yoke and the armature.

The above object is inventively achieved in an electromagnetic relay having a flat armature with a bearing edge which is biased by a bearing spring, the bearing edge of the armature being disposed in a recess in the yoke plate and the spring being connected to the armature at a specific distance from the bearing edge.

In this inventive structure, the armature is mounted on the yoke in such a manner that during the switching movements the bearing edge rolls substantially on the same imaginary line of the yoke plate, and thus moves in substantially friction free fashion. The bearing spring determines not only the bearing force on the armature, but also the armature resetting force as well as a rest contact force for the contact springs which are to be actuated by movement of the armature.

It is preferable that the clamping point of the bearing spring in the relay is in the same plane as the bearing surface between the armature and the yoke, and that in the region of the bearing edge of the armature the bearing spring is bent into the yoke recess. This can be achieved, for example, by means of two bends in opposite directions which are selected to establish the desired forces acting upon the armature.

The armature bearing is subject to particularly low friction when a specific length ratio of the distance between the clamping point of the bearing spring and the bearing edge of the armature, to the distance between the attachment point of the bearing spring to the armature and the bearing point is utilized. This length ratio is selected such that the tangent at the attachment point of the bearing spring at the two end positions of the armature passes through the bearing position. In a preferred embodiment of the invention, this length ratio is selected such that the distance between the bearing point of the armature and the attachment point of the bearing spring to the armature is double the distance from the bearing point of the armature to the clamping point of the bearing spring.

DESCRIPTION OF THE PREFERRED EMBODIMENTS

Figure 1:
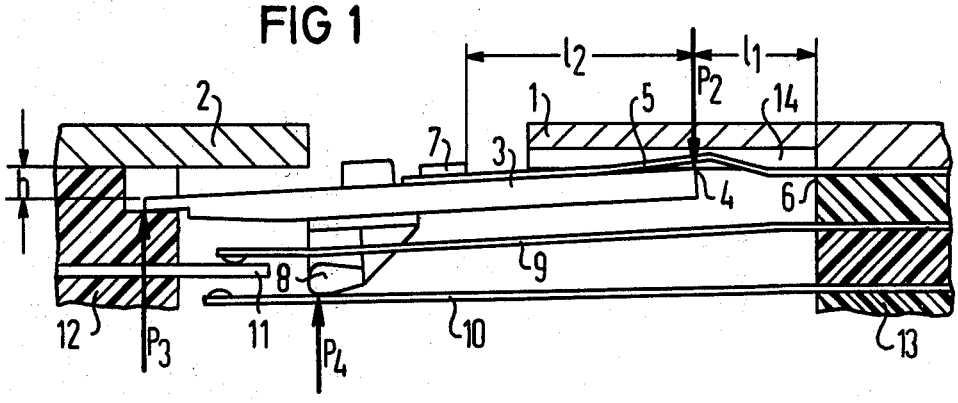
FIG. 1 is a sectional view of an electromagnetic relay having a flat armature constructed in accordance with the principles of the present invention in a rest position.

A portion of an electromagnetic relay is shown in section in FIG. 1 having a yoke plate 1 and a pole plate 2 disposed in substantially the same plane. Portions of the relay not essential to the inventive concept disclosed herein have been omitted. A flat armature 3, which forms an operating air gap h with the pole plate 2, is mounted on the yoke plate 1. The armature 3 has a bearing edge 4 which rolls on the yoke plate 1, and the armature 3 is both held and biased by a bearing spring 5. The bearing spring 5 is connected to the yoke plate 1 at a clamping position 6 and bears the armature 3 at an attachment point 7. In the embodiment shown in FIG. 1, the bearing spring 5 is attached to the armature 3 by a rivet, however, it will be apparent that other conventional means of attachment such as welding or screwing can also be employed without departing from the inventive concept disclosed herein.

The armature 3 operates self-biased spring contacts 9 and 10 via a slide 8 to make and break contact with a fixed central contact 11. The central contact 11 is secured in an insulating carrier 12 together with the pole plate 2, and the contacts 9 and 10 together with the yoke plate 1 and the bearing spring 6 are supported by an insulating layer 13 or other insulating body.

FIG. 1 illustrates the magnetic relay system in a rest state. In this state, the bearing spring 5 produces a bearing force $P_2$, a specific armature resetting force $P_3$, and, for the self-biasing contact arrangement, an actuating force $P_4$ which acts against the contact spring 11. These forces are schematically represented by the arrows in FIG. 1 in the direction of the forces.

Figure 2:
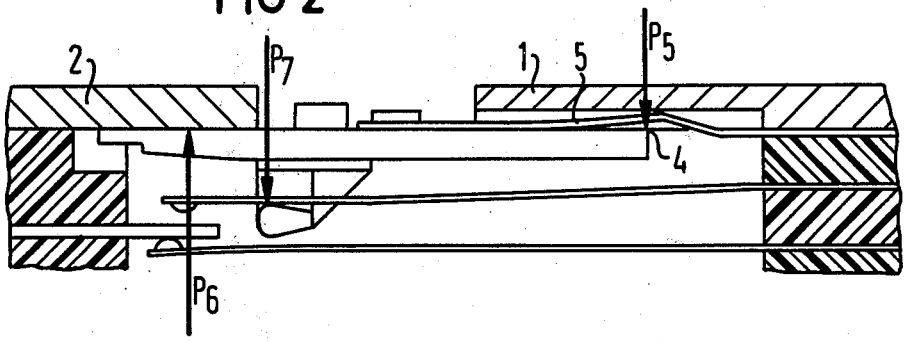
FIG. 2 is a sectional view of the electromagnetic relay of FIG. 1 in an operating position.

The same armature is shown in an operating state in FIG. 2, wherein a bearing force $P_5$, a magnetic force $P_6$ and an actuating force $P_7$ are present and act on the relay in the direction shown by the respective arrows.

In order that, during operation, the armature 3 can rest flat on the pole plate 2 and the yoke plate 1, the bearing spring 5 is disposed in a groove or recess 14 in the yoke plate 1. The bearing spring 5 is bent into the recess 14 by two bends. These bends are selected in such a manner that the desired forces are generated in the particular switching state employed.

Specific distances $l_1$ and $l_2$ are selected between the clamping point 6 of the bearing spring and the bearing edge 4 of the armature, and between the bearing edge 4 and the attachment point 7 of the spring 5 to the armature 3. The ratio of the distances $l_1$ and $l_2$ is selected such that when the armature 3 is actuated, the bearing edge 4 exerts virtually no friction on the yoke plate 1.

Figure 3:
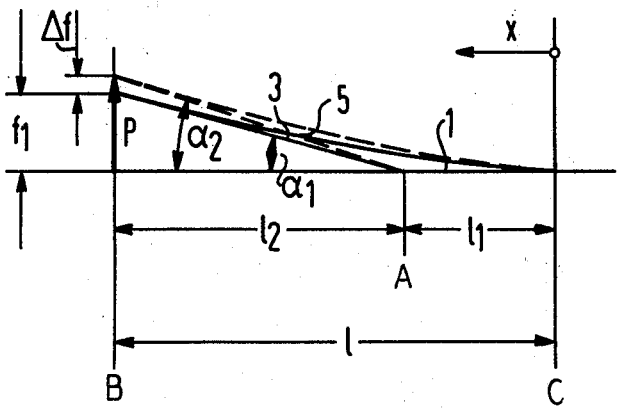
FIG. 3 is a graphical representation of the forces acting upon the elements of the relay shown in FIGS. 1 and 2 which is utilized for calculating an optimum length ratio for bending the bearing spring.

The calculation of an optimum length ratio of $l_2$ to $l_1$ is explained with reference to the graph shown in FIG. 3. FIG. 3 schematically illustrates the bearing spring 5, the armature 3 and the yoke plate 1. The bearing spring 5 is clamped at a point C and is deflected at a point B. For simplicity, it will be assumed that simply a force P acts on the spring 5 at the deflection point B. The bearing point of the armature 3 on the yoke plate 1 is designated at A.

If a spring having a length l is biased by an amount $f_1$, the angle of inclination $\alpha_1$ occurs at the deflection point B. If the spring is further deflected by an amount $\Delta f$, an angle of inclination $\alpha_2$ occurs at the deflection point B.

These two angles of inclination which arise by differing deflections of the spring are governed by the following equation:

$$\tan \alpha_1 = \frac{f_1 \int_0^l (l-x)dx}{\int_0^l [\int (l-x)dx]dx} = \frac{3f_1}{2l}, \text{ and similarly}$$

$$\tan \alpha_2 = \frac{3(f_1 + \Delta f)}{2l},$$

so that $$\tan \alpha_2 - \tan \alpha_1 = 3\Delta f/2l.$$

The following geometric equation is obtained from FIG. 3;

$$\tan \alpha_1 = f_1/l_2;\ \tan \alpha_2 = (f_1 + \Delta f)/l_2,$$

and by substitution $$\frac{f_1 + \Delta f}{l_2} - \frac{f_1}{l_2} = \frac{3\Delta f}{2l},$$

or $$\Delta f/l_2 = 3\Delta f/2l, \text{ so that } 1/l_2 = 3/2l$$

Because $l = l_1 + l_2$, then $l_1/l_2$, then $l_1/l_2 = \frac{1}{2}$.

By adhering approximately to the length ratio of 1:2 for the bearing position of the armature 3, an armature bearing is obtained which is substantially free of friction when a force P acts at the deflection point. If a number of different forces act upon the armature or on the spring, the corresponding length ratio between $l_1$ and $l_2$ can be determined by known mathematical methods similar to that employed above.

Although modifications and changes may be suggested by those skilled in the art it is the intention of the inventor to embody within the patent warranted hereon all changes and modifications as reasonably and properly come within the scope of his contribution to the art.

I claim as my invention:

1. An electromagnetic relay comprising:

a yoke plate having a recess therein;

a pole plate disposed substantially coplanar with said yoke plate;

an armature pivotable between a rest position and an operating position which is substantially parallel to said yoke plate and said pole plate for making breaking spring contacts in said relay, said armature having a bearing edge; and a bearing spring for supporting and biasing said armature, said bearing spring being disposed in said recess in said yoke plate and being connected to said armature at an attachment point about which said armature pivots, said attachment point disposed at a selected distance from said bearing edge such that said bearing edge moves on substantially a single line when said armature is pivoted between said rest position and said operating position whereby said armature pivots causing substantially no contact between said bearing spring and said yoke plate.

2. The relay of claim 1 wherein said bearing spring is clamped parallel to said yoke plate at a clamping point and is bent into said recess in said yoke plate.

3. The relay of claim 2 wherein said bearing spring in said recess in said yoke plate is bent at a double bend in opposite directions.

4. The relay of claim 2 wherein a ratio of a distance between said clamping point and said bearing edge to a distance between said bearing edge and said attachment point is selected such that the tangent at the attachment point of the bearing spring in each of said rest and operating positions of said armature passes through said bearing edge.

5. The relay of claim 4 wherein said distance between said bearing edge and said attachment point is double said distance between said bearing edge and said clamping point.

* * * * *